United States Patent [19]

Komatsu et al.

[11] Patent Number: 4,878,391

[45] Date of Patent: Nov. 7, 1989

[54] MOTION TRANSLATING MECHANISM FOR USE AS A WINDOW REGULATOR OR THE LIKE

[75] Inventors: Haruo Komatsu; Takashi Suzuki, both of Shimizu, Japan

[73] Assignee: Koito Seisakusho Co., Ltd., Japan

[21] Appl. No.: 155,679

[22] Filed: Feb. 16, 1988

[30] Foreign Application Priority Data

Feb. 16, 1987 [JP] Japan ..... 62-32970
Jan. 12, 1988 [JP] Japan ..... 63-4388

[51] Int. Cl.[4] ..... E05F 5/06; E05D 3/00

[52] U.S. Cl. ..... 74/89.2; 74/89.22; 49/352

[58] Field of Search ..... 74/89.2, 89.22; 49/352

[56] References Cited

U.S. PATENT DOCUMENTS

| | | | |
|---|---|---|---|
| 2,987,937 | 6/1961 | Sala | 74/89.22 |
| 4,403,450 | 9/1983 | Ishii | 49/352 |
| 4,440,354 | 4/1984 | Kobayashi et al. | 242/54 R |
| 4,468,887 | 9/1984 | Koch | 49/352 |
| 4,589,227 | 5/1986 | Bickerstaff | 49/227 |
| 4,631,864 | 12/1986 | Barros | 49/352 |

FOREIGN PATENT DOCUMENTS

| | | | |
|---|---|---|---|
| 3638059 | 5/1987 | Fed. Rep. of Germany | 49/352 |
| 2382351 | 11/1978 | France | 49/352 |

*Primary Examiner*—Leslie A. Braun
*Assistant Examiner*—Scott Anchell
*Attorney, Agent, or Firm*—Sughrue, Mion, Zinn, Macpeak & Seas

[57] ABSTRACT

A mechanism particularly well suited for converting bidirectional rotation, as of a reversible electric motor or a hand crank, into the linear up and down motion of a windowpane relative to the frame of a passenger car door. Included is an elongate guide rail gently curved longitudinally to conform to the vertical curvature of the vehicular door and providing a vertical guideway on its convex side. A wire rope or cable is looped about a pair of terminal guide pulleys or nonrotatable guides on the opposite ends of the guide rail. One of the two stretches of the cable is coupled to a windowpane carriage which is coupled to the windowpane for joint up and down movement therewith along the guideway. A drive mechanism including a drive reel is mounted to the guide rail and coupled to the other stretch of the cable for bidirectionally driving the windowpane carriage along the guideway. The drive mechanism is compactly disposed on the concave side of the guide rail for minimal space requirement.

6 Claims, 16 Drawing Sheets

MOTION TRANSLATING MECHANISM FOR USE AS A WINDOW REGULATOR OR THE LIKE

BACKGROUND OF THE INVENTION

This invention relates to apparatus for translating rotary motion into substantially linear motion, and more particularly to a motion translating mechanism of the type defined which is well suited for use as a window regulator of passenger cars, among other applications. In this particular application the apparatus of this invention serves to convert the bidirectional rotation of a hand crank or of a reversible electric motor into the up and down motion of a pane or panel of glass or like material relative to a door frame of the vehicle.

Among the wide variety of devices heretofore suggested and used for opening and closing vehicular windows is the one employing a steel wire rope or cable as the primary means of motion translation. A typical conventional construction of this type of window regulator is such that the cable is looped about a pair of guide reels or nonrotatable cable guides disposed at the opposite ends of a guide rail which is to be mounted in an upstanding attitude to the vehicular door frame for guiding the up and down motion of a carriage supporting the windowpane. One of the two stretches of the cable, extending between the pair of guide reels, is coupled to the windowpane carriage. Extending away from the guide rail in order to avoid interference with the windowpane carriage, the other cable stretch is wound several turns about a drive reel positioned some distance away from the guide rail. A hand crank or a reversible electric motor is the familiar means for bidirectionally revolving the drive reel.

Thus, with the bidirectional rotation of the drive pulley, the windowpane carriage slides up and down over the upstanding guide rail thereby moving the windowpane between the closed and open positions with respect to the door frame.

This known cable type apparatus posseses the advantages of simple construction, reliable operation and low manufacturing cost. Offsetting all these advantages is its large space requirement arising from the positioning of the drive reel a substantial distance away from the guide rail. It is, indeed, this weakness of the conventional motion translating mechanism that has restricted its application to vehicular window regulators in the face of its noted strengths. The mechanism will certainly lend itself to a diversity of different applications only if it is of more compact construction.

The automotive industry itself has long awaited the advent of more compact window regulators. The doors of passenger cars today contain a variety of devices in addition to window regulators, examples being door locks and their remote controls, cigarette lighters and ashtrays, windshield wiper controls, seat adjustment controls, and rearview mirrors and controls. Thus, with the introduction of many sophisticated door attachments and accessories, vehicle doors are becoming more and more crowded than they used to be, imposing proportionately greater limitations on the spaces available for window regulators.

SUMMARY OF THE INVENTION

The present invention aims at the provision of a motion translating mechanism of the type indicated which is made far compact in construction than heretofore without loss or diminution of its advantages.

In summary the motion translating mechanism of this invention comprises elongate guide means providing a substantially linear guideway, with a pair of terminal cable guides mounted to the guide means adjacent the opposite ends thereof. A cable, or an equivalent elongate, flexible and nonstretchable member is looped about the pair of terminal cable guides thereby providing first and second stretches, at least the first stretch of the cable extending along the guideway. A movable member such as a windowpane carriage is coupled to the first stretch of the cable for joint bidirectional movement therewith. A drive reel is rotatably mounted directly on the elongate guide means, in a position intermediate the opposite ends thereof, and has the second stretch of the cable wound one or more turns thereon. Either a hand crank or a reversible electric motor may be coupled to the drive reel for bidirectionally driving the same and hence for causing the movable member to travel back and forth along the guideway with the first stretch of the cable.

As the drive reel is mounted to the elongate guide means, the two stretches of the cable looped about the pair of terminal cable guides on the guide means extend substantially parallel to each other. Consequently, the motion translating mechanism demands drastically less installation space than does the comparable conventional apparatus.

In the use of the motion translating mechanism as a vehicular window regulator, the elongate guide means must be gently curved longitudinally to conform to the vertical curvature of the vehicle door. The cable drive means including the drive reel may be disposed, either wholly or in part, on the concave side of the guide means and coupled to the cable which mostly runs on the convex side of the guide means. The transverse dimension of the mechanism will then be reduced to an absolute minimum without substantially adding to its thickness dimension.

The above and other features and advantages of this invention and the manner of realizing them will become more apparent, and the invention itself will best be understood, from a study of the following description and appended claims, with reference had to the attached drawings showing some preferable embodiments of the invention.

DESCRIPTION OF THE PREFERRED EMBODIMENTS

General

Figure 1:
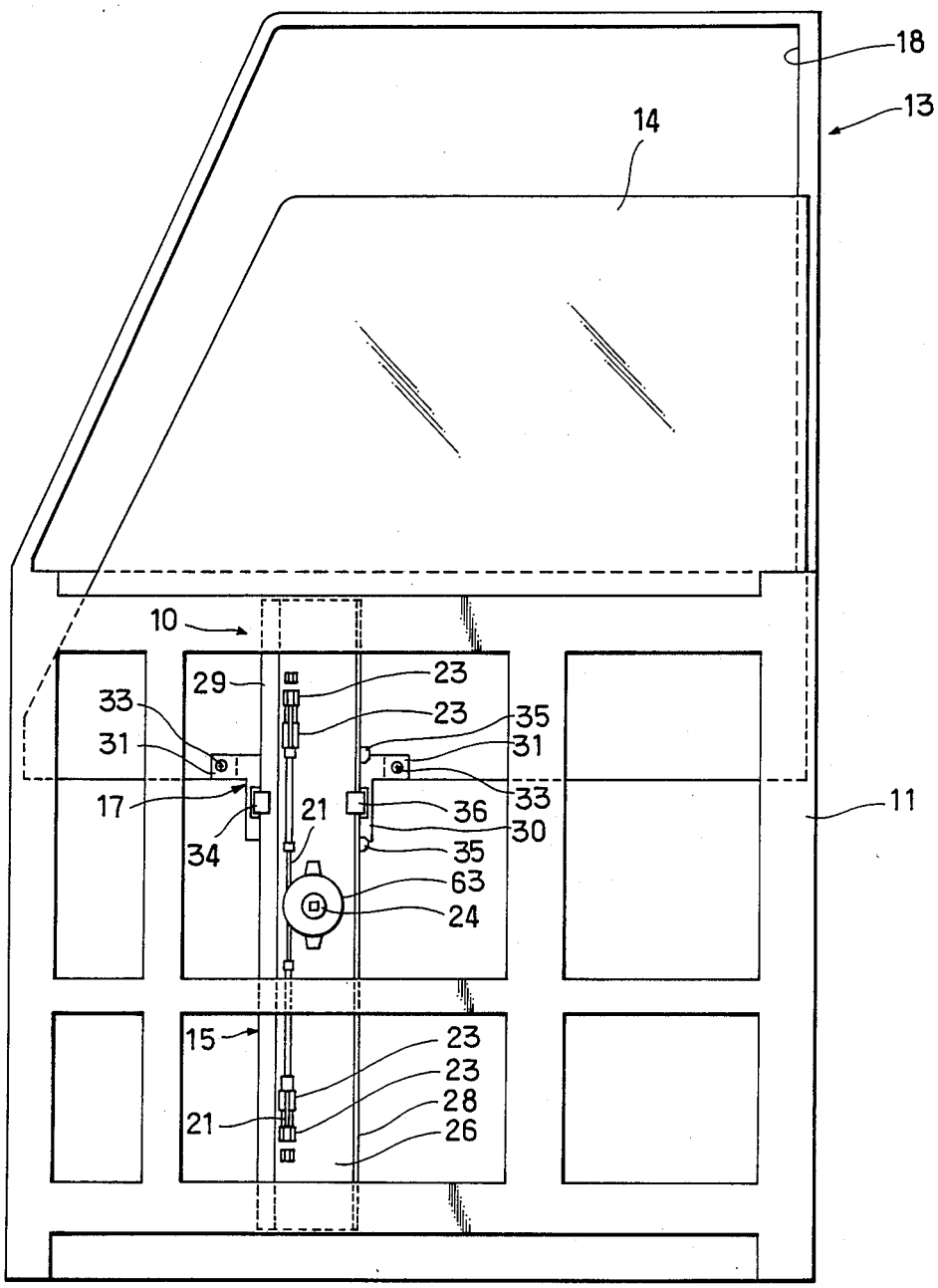
FIG. 1 is an elevation of a vehicle door, as seen from within the vehicle, the vehicle door being shown with its inner lining removed to reveal the window regulator representing a preferred form of the motion translating apparatus in accordance with the invention.

The invention will now be described in detail as embodied in the vehicular window regulator generally designated 10 in FIGS. 1-3. FIG. 1 shows the window regulator 10 mounted to the frame 11 of a vehicle door 13 for moving a pane or panel 14 of vitreous material up and down with respect to the door frame 11. As illustrated on an enlarged scale in FIGS. 2 and 3, the window regulator 10 comprises an elongate guide rail 15 providing a generally vertical guideway 16, FIG. 2, for guideing the up and down motion of a windowpane carriage 17. FIG. 1 indicates that the windowpane carriage 17 is fastened to the bottom edge of the windowpane 14. Therefore, as the windowpane carriage 17 slides up and down over the guide rail 15, so does the windowpane 14 with respect to the door frame 11 thereby opening and closing a window opening 18 therein.

Figure 3:
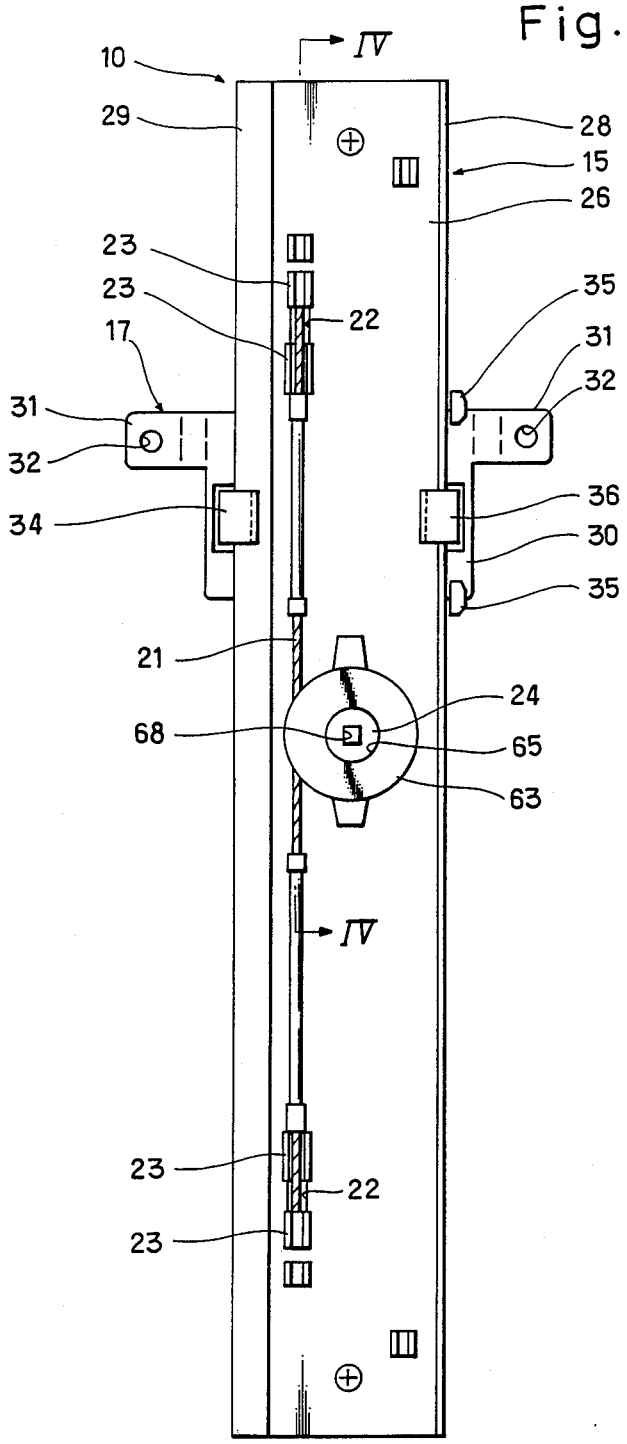
FIG. 3 is an enlarged rear or interior elevation of the window regulator.
Figure 4:
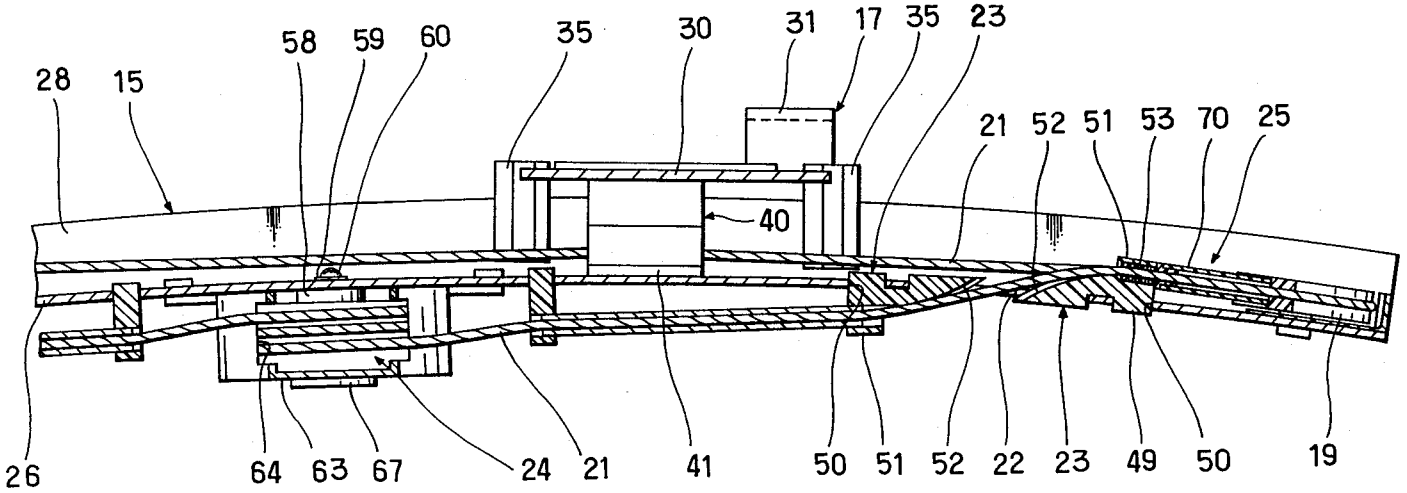
FIG. 4 is an enlarged, fragmentary section through the window regulator, taken along the line IV—IV in FIGS. 2 and 3 and showing in particular how the cable is guided from the convex to the concave side of the guide rail.

It will be observed from FIG. 4 that the guide rail 15 is gently curved longitudinally in conformity with the vertical curvature of the vehicle door 13. Thus the guide rail 15 has a concave side directed interiorly of the vehicle and revealed in FIGS. 1 and 3, and a convex side directed exteriorly of the vehicle and revealed in FIG. 2. The windowpane carriage 17 is mounted to the convex or exterior side of the guide rail 15.

Figure 2:
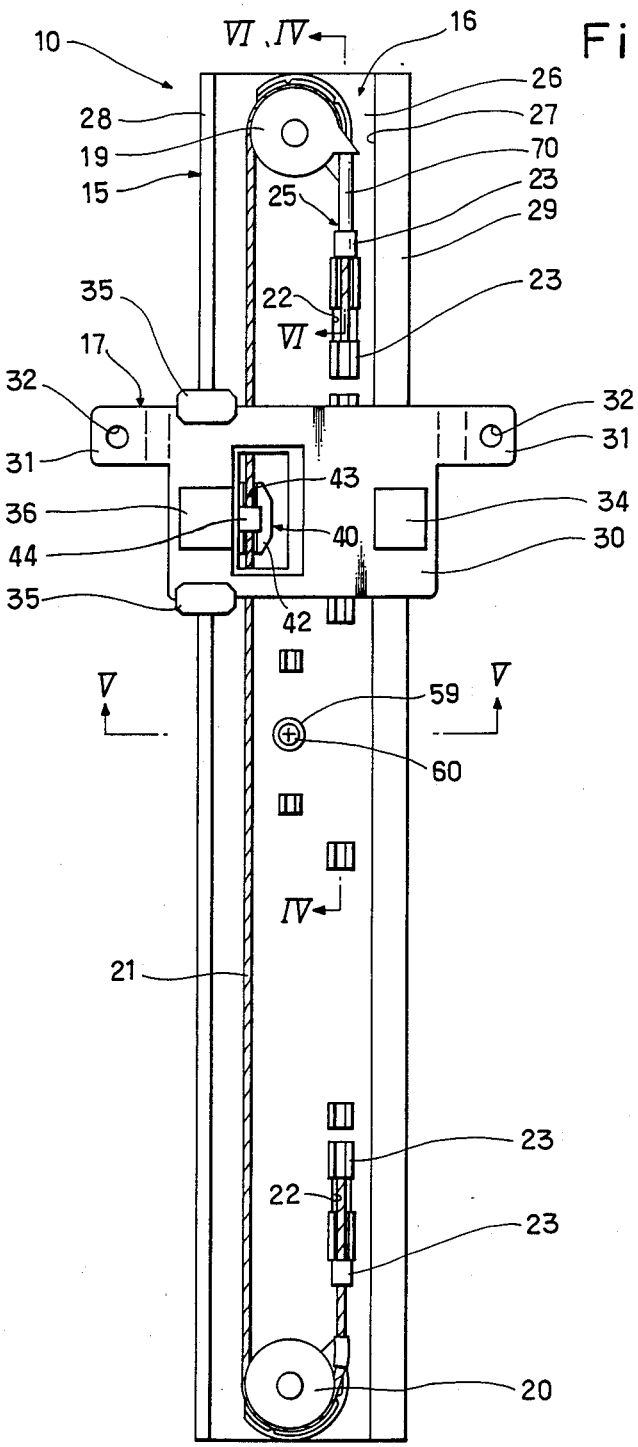
FIG. 2 is an enlarged front or exterior elevation of the window regulator of FIG. 1.

FIG. 2 shows that a pair of terminal cable guides 19 and 20 are mounted to the convex side of the guide rail 15 adjacent its opposite ends. The terminal cable guides 19 and 20 are each in the shape of a relatively thick disk, with a groove cut in its periphery. The upper guide 19 is nonrotatable, and the lower guide 20 rotatable, in this particular embodiment. Looped about the pair of terminal guides 19 and 20 is an endless wire rope or cable 21 which conventionally comprises stranded steel wires, although a synthetic fiber rope could be employed. The word "cable" will be used in this disclosure to mean any elongate, flexible, nonstretchable element that may be used in this type of motion translating mechanism.

The first or left hand stretch, as viewed in FIG. 2, of the cable 21 wholly lies on the convex side of the guide rail 15, extending along the guideway 16, and is coupled to the windowpane carriage 17. However, as will be seen also from FIGS. 3 and 4, the second or right hand stretch of the cable 21 is partly disposed on the concave side of the guide rail 15 by being threaded through a pair of longitudinally spaced openings 22 in the guide rail. Two pairs of middle cable guides 23 are mounted fast to the guide rail 15, each pair of such guides being opposed to each other across each opening 22 for smoothly guiding the travel of the cable 21 therethrough between the convex and concave sides of the guide rail with a minimum of sliding friction. The two pairs of middle cable guides 23 can all be of substantially identical make.

On the concave side of the guide rail 15 the cable 21 is wound one or more turns around a drive reel rotatably mounted to the guide rail. Thus, with the bidirectional rotation of the drive reel 24, the cable 21 will be driven frictionally for moving the windowpane carriage 17 up and down along the guide rail 15.

As an incidental feature of the invention the cable 21 is provided with slack take up means generally labeled 25 in FIGS. 2 and 4. The slack take up means 25 serves to remove looseness from the cable 21 in the use of the window regulator 10.

The following is a more detailed description of the guide rail 15, windowpane carriage 17, terminal cable guides 19 and 20, middle cable guides 23, drive reel 24, and slack take up means 25, in that order, followed by a discussion of how the cable 21 is threaded through the window regulator 10 and of the operation of the complete apparatus.

Guide Rail

Figure 5:
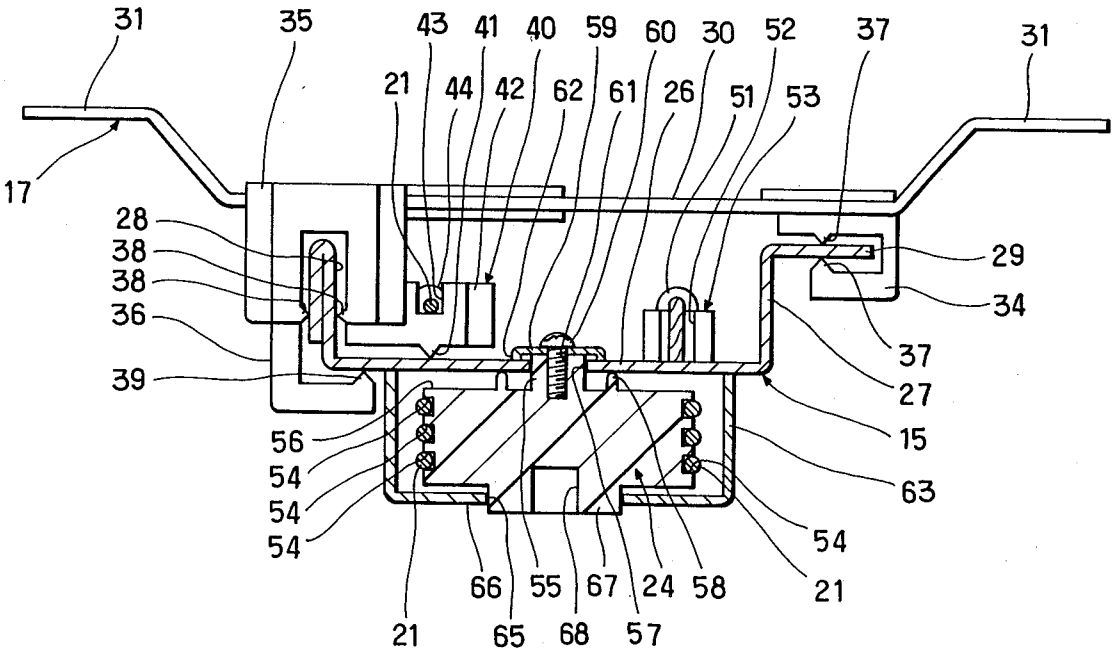
FIG. 5 is an enlarged section through the window regulator, taken along the line V—V in FIG. 2 and showing in particular how the windowpane carriage is slidably engaged with the guide rail.

As pictured cross sectionally in FIG. 5, the guide rail 15 is a channel-shaped piece of sheet metal, comprising a web 26 and a pair of side flanges 27 and 28 extending from the opposite longitudinal edges of the web toward the convex or exterior side of the guide rail. The side flange 27 has a rim 29 extending away from the other side flange 28 in parallel relation to the web 26. The side flange 28 is doubled over itself for greater strength.

Windowpane Carriage

While the windowpane carriage 17 appears in all of FIGS. 1-5, FIGS. 2 and 5 best indicate that it has a flat major portion 30 and a pair of carrier arms 31 which are integrally made of sheet metal material. The major portion 30 has a transverse dimension slightly more than the width of the guide rail 15, and the pair of carrier arms 31 extend in opposite directions from both sides of the major portion. Each carrier arm 31 has a hole 32 formed therein. A reference back to FIG. 1 will show that the carrier arms 31 are fastened to the bottom edge of the windowpane 14 by bolts 33 extending through the holes 32. So carrying the windowpane 14, the carriage 17 travels up and down therewith over the guide rail 15.

For sliding engagement with the guide rail 15, the windowpane carriage 17 has a first shoe 34, a second pair of shoes 35 and a third show 36, which are all molded from a rigid plastic in place on the major portion 30 of the sheet metal window carriage. The first shoe 34 is generally in the shape of a recumbent U, as seen cross sectionally as in FIG. 5, embracing the rim 29 of the guide rail flange 27. A pair of slide ribs 37 are formed on the confronting surfaces of the first shoe 34 for sliding contact with the opposite surfaces of the rim 29. Thus the first shoe 34 slidably engages the guide rail 15 so as to prevent displacement of the right hand portion, as seen in FIGS. 2 and 5, of the windowpane carriage 17 relative to the guide rail in a direction normal to the plane of the guide rail web 26.

The second pair of shoes 35, spaced from each other longitudinally of the guide rail 15, are each in the shape of an inverted U, as viewed in FIG. 5, and embrace the doubled flange 28 of the guide rail 15. A pair of slide ribs 38 are formed on the confronting surfaces of each second shoe 35 for sliding engagement with the opposite surfaces of the guide rail flange 28. Consequently, the windowpane carriage 17 is restrained from displacement relative to the guide rail 15 in a direction parallel to the plane of the guide rail web 26.

Disposed intermediate the second pair of shoes 35, the third shoe 36 is generally L shaped. A slide rib 39 is formed on the distal end, end away from the windowpane carriage 17, of the third shoe 36 for sliding engagement with the interior surface of the guide rail web 26. The third shoe 36 serves to prevent displacement of the left hand portion, as viewed in FIGS. 2 and 5, of the windowpane carriage 17 away from the guide rail 15 in a direction normal to the plane of the guide rail web 26.

It will have been seen from the foregoing that the shoes 34–36 conjointly serve to constrain the windowpane carriage 17 to longitudinal sliding motion with respect to the guide rail 15.

The windowpane carriage 17 must be coupled to the first stretch, thoroughly disposed on the convex side of the guide rail 15 as in FIG. 2, of the cable 21 for each bidirectional sliding motion along the guide rail 15. Toward this end the windowpane carriage 17 has a coupling shoe 40, FIGS. 2–5, of a rigid plastic molded in one piece therewith in the proximity of the third shoe 36. The coupling shoe 40 is also U shaped, as seen in FIG. 5, and has a slide rib 41 for sliding engagement with the exterior surface of the guide rail web 26. Formed in the surface 42, directed away from the guide rail web 26, of the coupling shoe 40 is a groove 43 extending longitudinally of the guide rail 15. As seen in both FIGS. 2 and 5, a coupling ring or tube 44 is fitted over the first stretch of the cable 21 and tightened thereon against displacement with respect to the cable. This coupling ring 44, together with part of the cable 21 engaged thereby, is pressfitted in the groove 43 in the coupling shoe 40. Thus the windowpane carriage 17 is firmly coupled to the cable 21 in the simplest, most practical manner.

Terminal Cable Guides

Figure 6:
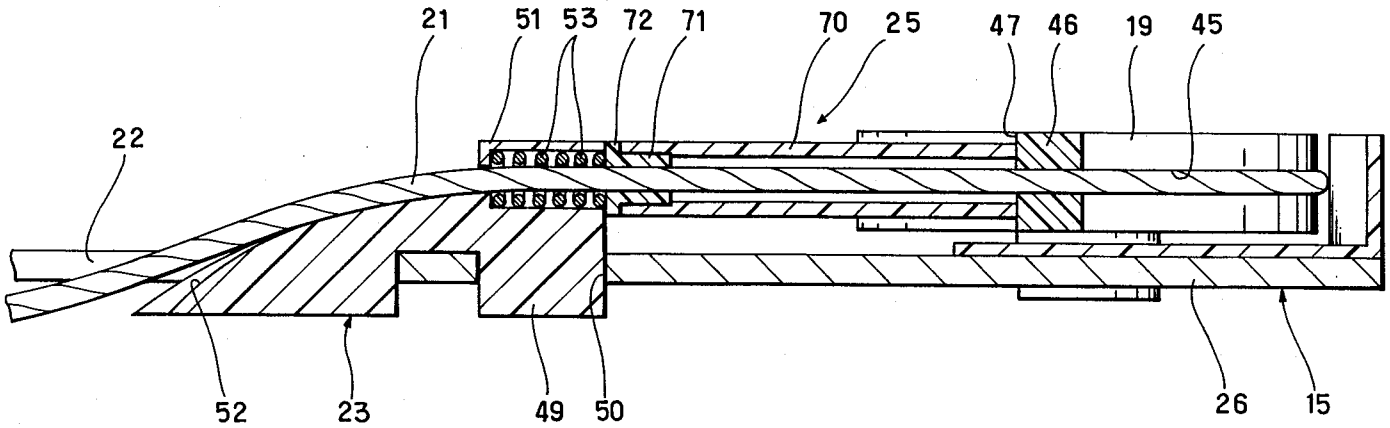
FIG. 6 is an enlarged, fragmentary section through the window regulator, taken along the line VI—VI in FIG. 2 and showing in particular one of the middle cable guide and the slack take up means.
Figure 7:
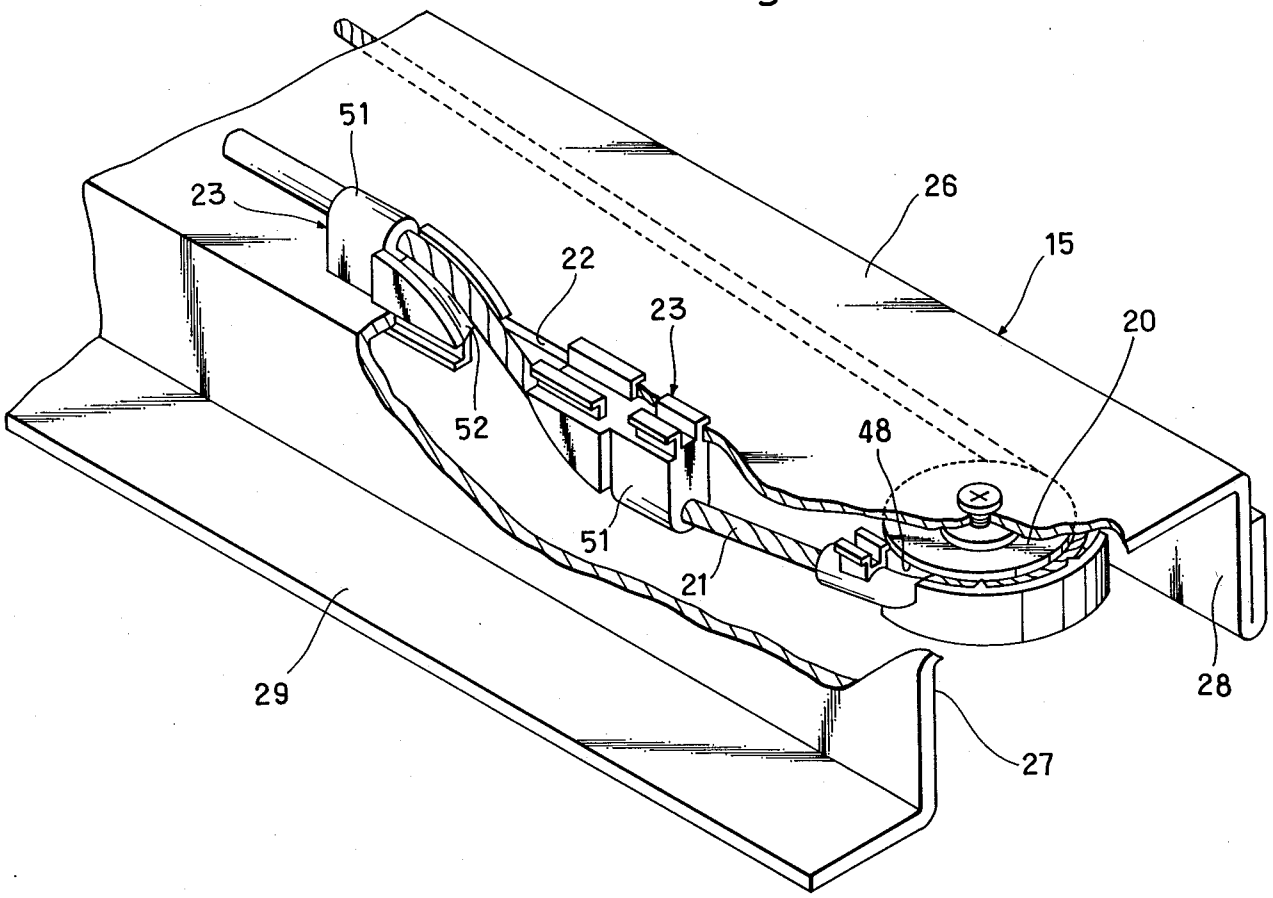
FIG. 7 is an enlarged, fragmentary perspective view, with a part shown broken away to reveal other parts, showing the lower end portion of the guide rail together with the lower terminal cable guide and the lower pair of middle cable guides.

The upper terminal cable guide 19 is seen in FIGS. 2 and 6, and the lower terminal cable guide 20 in FIGS. 2 and 7. Nonrotatably mounted to the web 26 of the guide rail 15, the upper terminal cable guide 19 is generally in the form of a relatively thick disk, having a groove 45 cut in approximately the upper half of its periphery for slidably receiving the cable 21. A lobe 46 extends radially outwardly from the cable guide 19 to provide an abutment 47 forming a part of the slack take up means 25 to be detailed presently. The cable guide 19 could take the form of a rotatable pulley, of course, but is made nonrotatable in this particular embodiment because the abutment 47 must be immovable with respect to the guide rail 15.

The lower terminal cable guide 20 is shown as a pulley rotatably mounted on the web 26 of the guide rail 15, with a groove 48 formed in its periphery for receiving the cable 21. As desired, the cable guide 20 may be made nonrotatable, provided that its material is well chosen to resist wear and to offer minimal frictional resistance to the cable 21 sliding thereover.

Middle Cable Guides

The two pairs of middle cable guides 23 are molded from an antifriction plastic material in place on the guide rail 15. Since they can all be of like shape and size, only one of them will be described in detail in conjunction with one other associated middle cable guide, and the various parts of the other guides will be identified by the same reference numerals used to denote the corresponding parts of the representative guide.

With reference to FIG. 6, which shows the uppermost middle cable guide 23, it will be seen that this representative guide is mostly disposed on the convex side of the guide rail 15 and retained in position thereon by having its leg 49 closely engaged in a square opening 50 in the guide rail web 26. The cable guide 23 additionally comprises a tubular guide portion 51 and a sloping guide groove 52. The tubular guide portion 51 extends parallel to the guide rail 15 to permit the second stretch of the cable 21 to travel therethrough. In direct communication with the tubular guide portion 51, the sloping guide groove 52 is gently curved as it extends through the upper opening 22 in the guide rail web 26 from the convex to the concave side of the guide rail. A helical compression spring 53 within the tubular guide portion 51 of the uppermost cable guide 23 constitutes a part of the slack take up means 25, as will be later referred to in more detail.

FIG. 4 clearly indicates that the middle cable guide 23 immediately underlying the uppermost guide 23 is mounted opposite thereto across the upper opening 22 in the guide rail web 26. Let us call the uppermost guide the first guide, and the associated underlying guide the second guide. The second guide is reversed with respect to the first guide not only vertically but also horizontally. Therefore, largely disposed on the concave side of the guide rail 15, the second guide has its sloping guide groove 52 extending through the opening 22 for guiding the cable 21 therethrough in cooperation of the sloping guide groove 52 of the first guide. The tubular guide portion 51 lies wholly on the concave side of the guide rail 15 for guiding the cable 21 between the upper opening 22 and the drive reel 24. Thus the upper pair of middle cable guides 23 functions to guide the cable 21 between the upper terminal cable guide 19 and the drive reel 24 through the upper opening 22.

As will be understood from FIG. 7, the other pair of middle cable guides 23, associated with the lower opening 22 in the guide rail web 26, are of the same arrangement as the first recited pair of guides 23, with the lowermost one largely disposed on the convex side of the guide rail, and the overlying one on the concave side. It is therefore self evident that the lower pair of middle cable guides 23 serves to guide the cable 21 between the lower terminal cable guide 20 and the drive reel 24 through the lower opening 22 in the guide rail web 26.

Drive Reel

Figure 8:
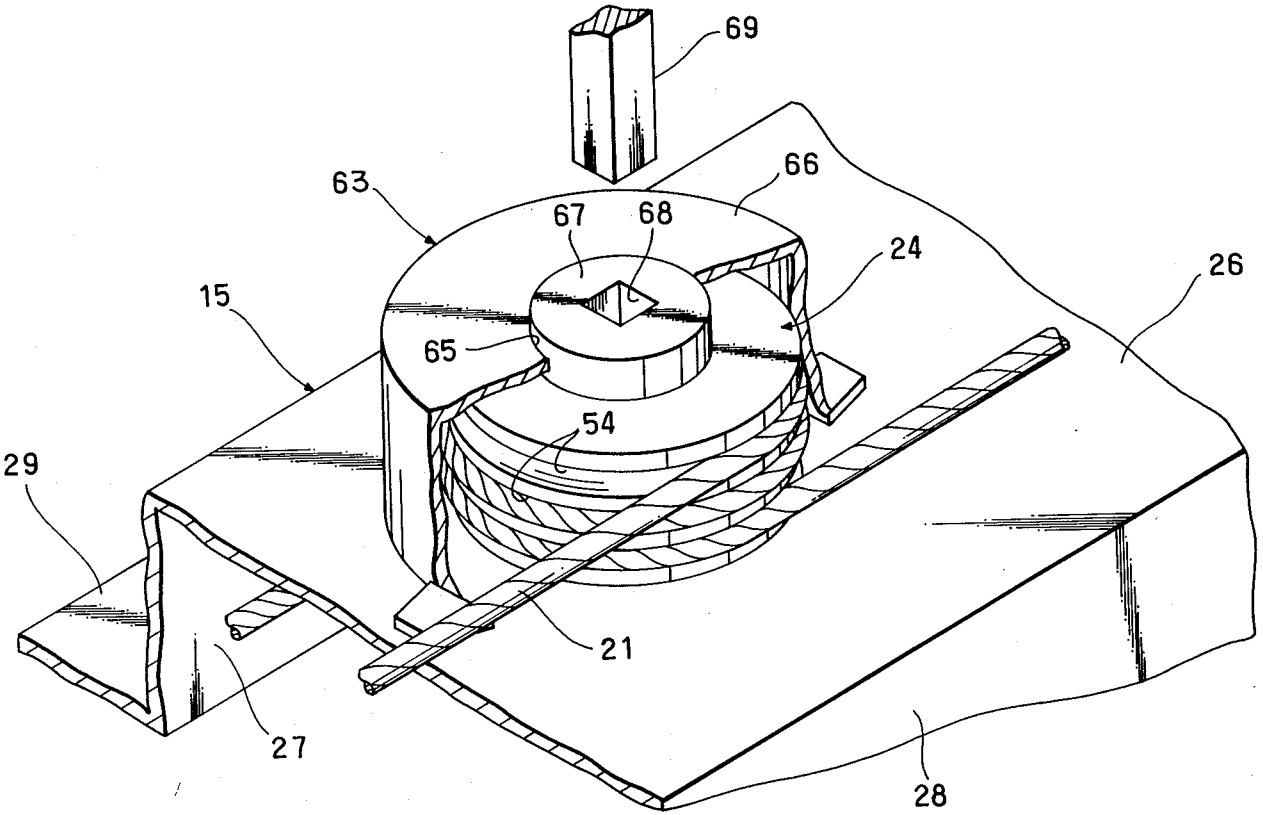
FIG. 8 is also an enlarged, fragmentary perspective view, with parts shown broken away to reveal other parts, showing in particular the drive reel and the hand crank for driving the window regulator.

Reference may be had principally to FIGS. 4, 5 and 8 for the following discussion of the drive reel 24 although it appears also in FIGS. 1 and 3. The drive reel 24 is compactly mounted on the concave interior side of the guide rail 15, in a position intermediate the opposite ends thereof, for rotation about an axis normal to the guide rail web 26. The cable 21 is wound one or more, three in this embodiment, turns about the guide reel 24 by being engaged in a helical groove 54 cut in its cylindrical surface.

As clearly seen in FIG. 5, the drive reel 24 has a concentric boss 55 protruding from its exterior end face 56 and rotatably extending through a hole 57 in the web 26 of the guide rail 15. An annular rib 58 is also formed on the end face 56 of the drive reel 24 so as to concentrically surround the boss 55. The rib 58 makes sliding contact with the interior surface of the guide rail web 26 as the boss 55 is fully inserted in and through the hole 57, thereby holding the drive reel end face 56 spaced from the guide rail web 26 for smoother rotation of the drive reel 24.

Protruding exteriorly of the guide rail web 26 from its hole 57, the drive reel boss 55 has a flange 59 secured endwise thereto by a screw 60 passing through a hole 61 in the flange. The flange 59 has a peripheral rim 62 slidably held against the exterior surface of the guide rail web 26. Thus the drive reel 24 rotates about its boss 55, with the drive reel rib 58 and flange rim 62 in sliding contact with the opposite surfaces of the drive reel web 26.

A reel housing 63 of cylindrical shape is secured endwise to the guide rail web 26 for concentrically enclosing the drive reel 24. The reel housing 63 is cut open at 64, FIG. 4, for the passage of the cable 21 into and out of the reel housing. An access opening 65 is formed centrally in the endplate 66 of the reel housing 63 to expose a boss 67, having a square shaped hole 68, on the interior end surface of the drive reel 24. The drive reel 24 can thus be revolved in either direction as by inserting a hand crank 69, FIG. 8, in the hole 68 in the drive reel boss 67 through the access opening 65 in the reel housing 63. Of course, an electric motor with an associated speed reducer could be employed for driving the drive reel 24.

Slack Take Up Means

Figure 9B:
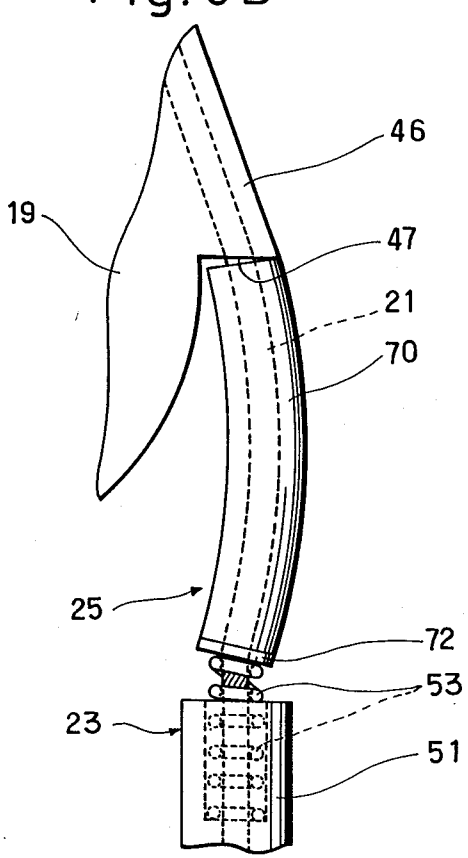
FIG. 9B is a view similar to FIG. 9A except that the slack take up means is shown in the state upon loosening of the cable.
Figure 9A:
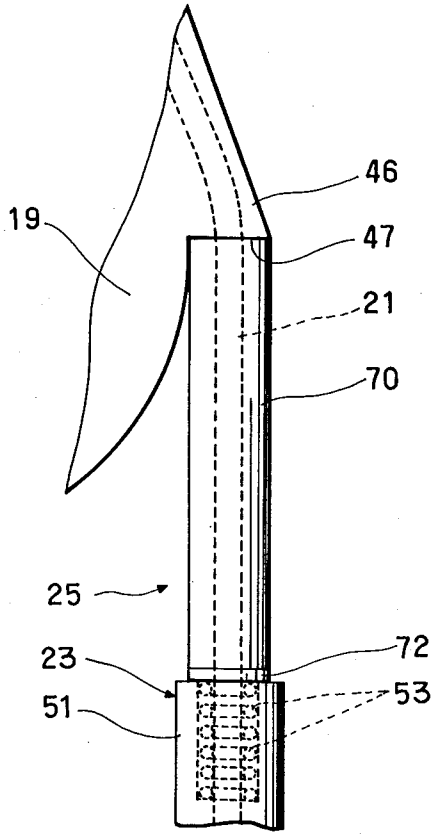
FIG. 9A is an enlarged elevation of the slack take up means of the window regulator, the take up means being herein shown in the state when the cable is fully tensioned.

The slack take up means 25 is seen in FIGS. 2, on an enlarged scale in FIG. 4, and on a still more enlarged scale in FIG. 6. FIGS. 9A and 9B also show the slack take up means 25 in two different states to be set forth shortly.

With particular reference to FIG. 6 the slack take up means 25 comprises a take up tube 70 of flexible material in addition to the noted abutment 47 and the helical compression spring 53. The take up tube 70 extends between the abutment 47 and the tubular portion 51 of the uppermost middle cable guide 23 for receiving with clearance the cable 21 extending therebetween. Closely engaged in one end, held opposite the middle cable guide 23, of the take up tube 70 is a relatively short tubular member 71 of a rigid plastic or like material having a flange 72 serving as a recinforcement or abutment for end to end engagement of the take up tube with the compression spring 53.

FIG. 9A shows the slack take up means 25 of the foregoing construction when the cable 21 is fully tensioned. It will be seen that the take up tube 70 extends rectilinearly between the uppermost middle cable guide 23 and the abutment 47, with the spring 53 compressed and fully received in the tubular portion 51 of the cable guide. Upon slacking of the cable 21 the take up tube 70 will flex under the force of the compression spring 53 thereby taking up the slack as in FIG. 9B.

Cable Threading

The cable 21 is endless in this particular embodiment. Looped about the pair of terminal cable guides 19 and 20 having the peripheral grooves 45 and 48, the cable 21 provides the first or left hand stretch, as viewed in FIG. 2, and the second or right hand stretch. The first cable stretch is wholly disposed on the convex side of the guide rail and extends along the guideway 16 for moving the windowpane carriage 17 up and down with respect to the guide rail 15.

The second cable stretch on leaving the upper terminal cable guide 19 is threaded into the take up tube 70, and then into the tubular portion 51 and groove 52 in the uppermost middle cable guide 23, thereby to be guided from the convex to the concave side of the guide rail 15 through the upper opening 22 in the guide rail web 26 as best seen in FIG. 4. Then the second cable stretch passes along the groove 52 in the second uppermost middle cable guide 23 into its tubular portion 51. Then the second cable stretch enters the reel housing 63 through its opening 64, is wound about the drive reel 24 along its spiral groove 54, and leaves the reel housing through the opening 64. Then, guided by the lower pair of middle cable guides 23, the second cable stretch travels through the lower opening 22 in the guide rail web 26 as shown in FIG. 7, thus returning from the concave to the convex side of the guide rail 15, and then is wound about half a turn around the lower terminal cable guide 20 along its peripheral groove 48.

Operation

The window regulator 10 of the foregoing construction is suitable for hand cranking. As the drive reel 24 is cranked in either direction, the cable 21 will be driven frictionally, resulting in the upward or downward travel of the windowpane carriage 17 and, therefore, in the movement of the windowpane 14 to the closed or open position with respect to the window opening 18 in the vehicle door frame 11.

As illustrated in FIG. 9A, the cable 21 will extend rectilinearly between the upper terminal cable guide 19 and the uppermost middle cable guide 23 as long as it remains fully tensioned. Fitted over the cable 21, the take up tube 70 of the slack take up means 25 will also be substantially straight. In event the cable 21 develops slack in the use of the window regulator 10, the take up tube 70 will flex and will be urged against the abutment 47 under the force of the compression spring 53, as shown in FIG. 9B, thereby taking up the slack and so maintaining the window regulator in good working order.

ALTERNATIVE EMBODIMENT

General

The alternative window regulator shown in FIGS. 10-16 represents an adaptation of the invention for driving by an electric motor rather than by a hand crank employed by the foregoing window regulator 10. The various parts of the alternative window regulator will be identified by the same reference numerals as used to denote the corresponding parts of the preceding embodiment, only with the digit "1" prefixed to such numerals.

Figure 10:
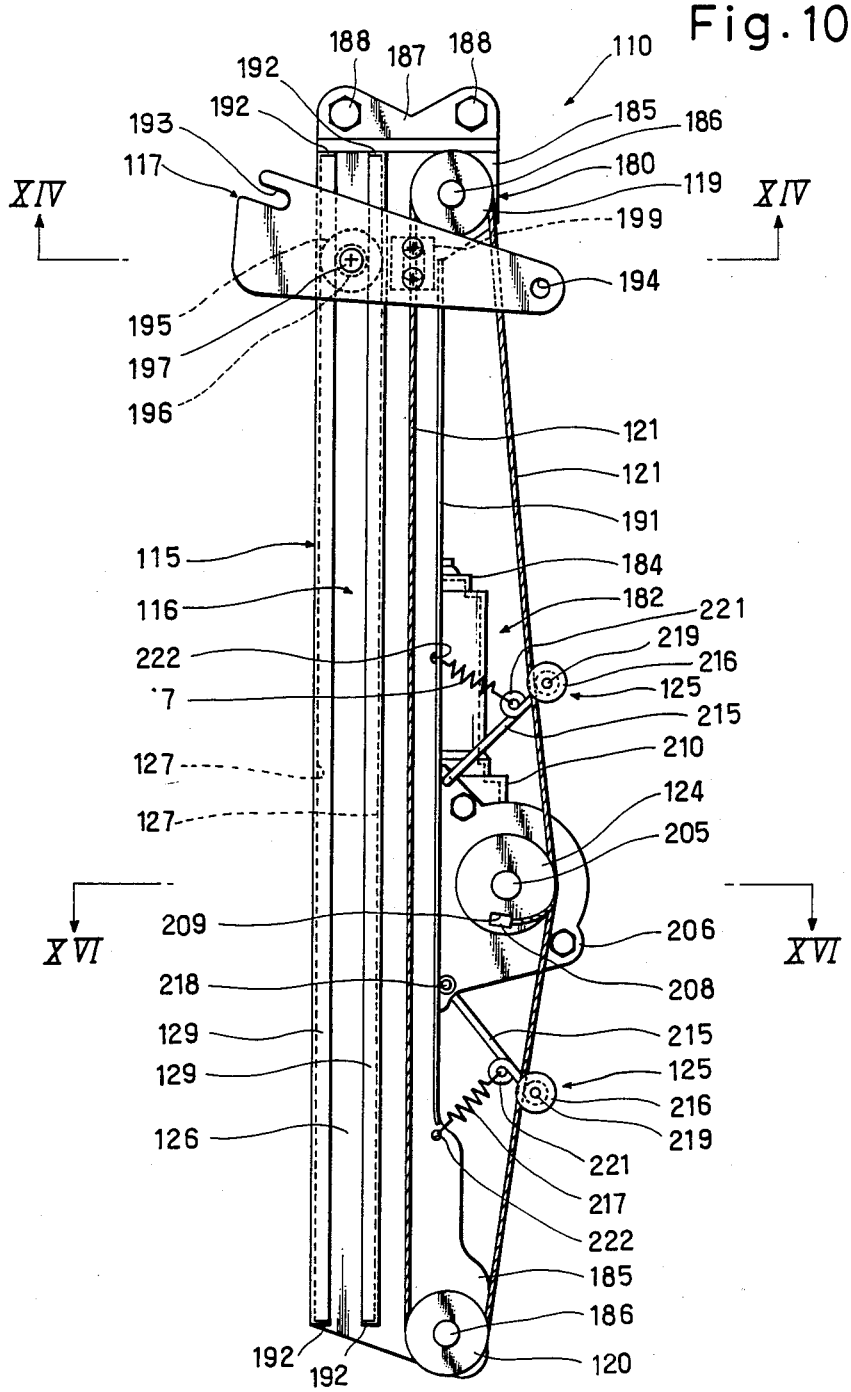
FIG. 10 is a front or exterior elevation of another preferred form of vehicle window regulator constructed in accordance with the invention.
Figure 11:
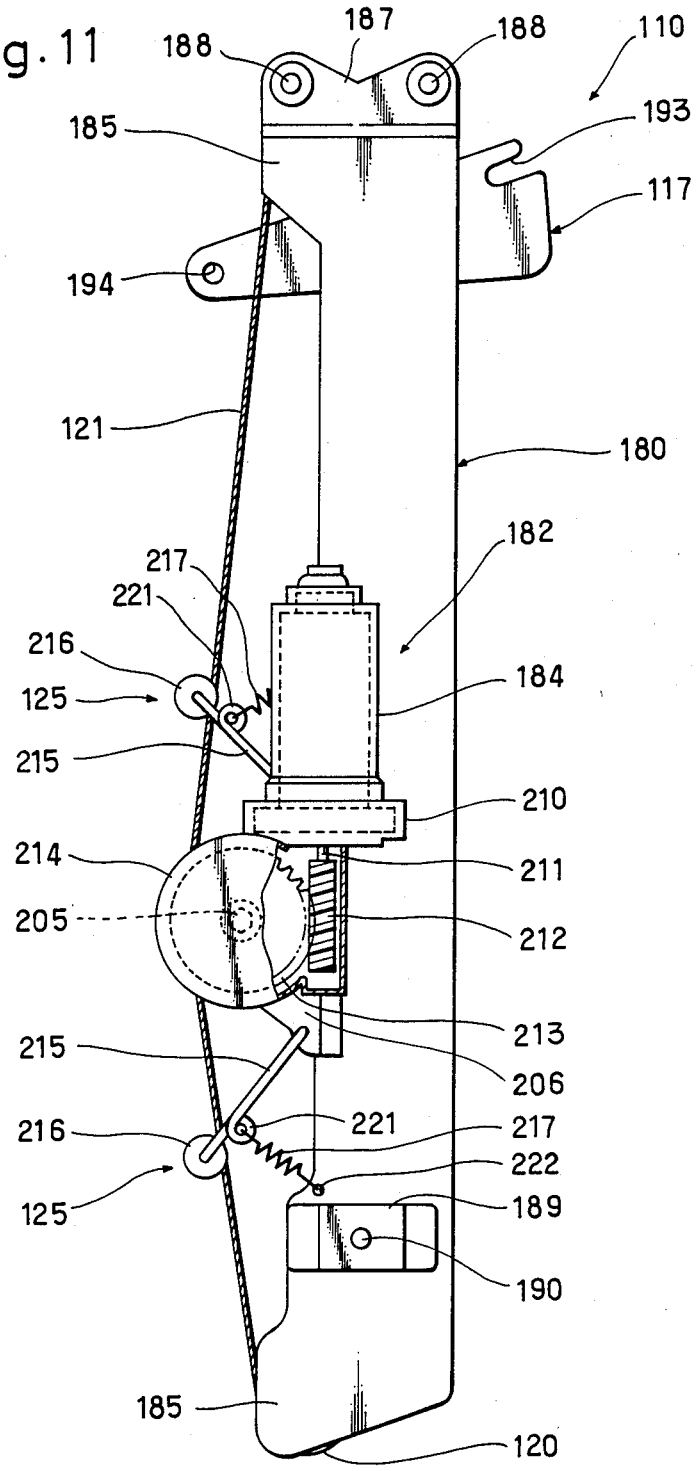
FIG. 11 is a rear or interior elevation of the window regulator of FIG. 10.
Figure 12:
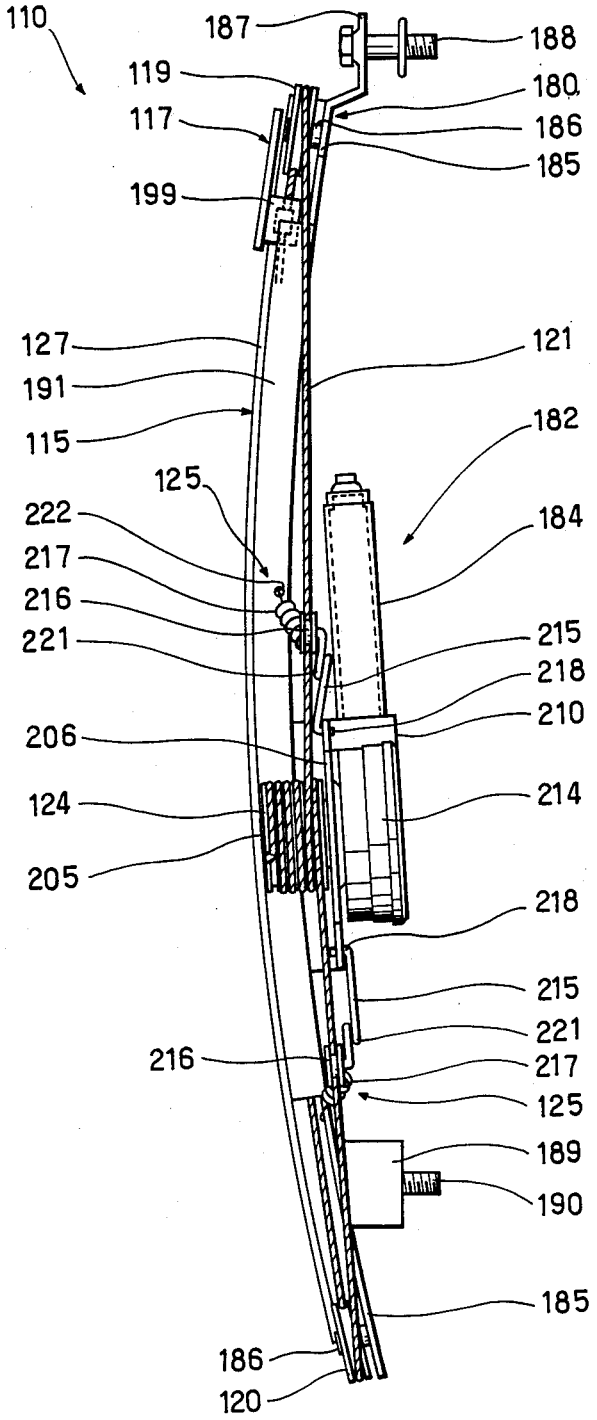
FIG. 12 is a right hand side elevation of the window regulator of FIG. 10.

Generally designated 110 in FIGS. 10–12, the alternative window regulator comprises an elongate, generally flat support structure 180 having a guide rail 115 rigidly attached thereto. The guide rail 115 extends along one of the opposite longitudinal edges of the support structure 18 to provide a generally vertical guideway 116, FIG. 10, for guiding a windowpane carriage 117. It is understood that the support structure 180 with the guide rail 115 is to be mounted to the frame of a vehicle door, and the windowpane carriage 117 to be coupled to the windowpane, as in the foregoing embodiment although the vehicle door is not shown for this alternative embodiment.

As clearly seen in FIG. 12, the support structure 180 with the guide rail 115 thereon is gently curved longitudinally, providing a concave side oriented rightwardly or interiorly of the vehicle door and a convex side oriented leftwardly or exteriorly of the vehicle door. The guide rail 115 together with the windowpane carriage 117 is mounted to the convex side of the support structure 180.

A pair of terminal cable guide pulleys 119 and 120 are rotatably mounted to the support structure 180 adjacent its opposite ends. Looped about the pulleys 119 and 120 is a cable 121 or like elongate, flexible, nonstretchable element providing a first or left hand stretch, as viewed in FIG. 10, and a second or right hand stretch. While the first cable stretch extends along the guide rail 115, the second cable stretch does not, being wound on a drive reel 124 rotatably mounted sideways to the support structure 180 in a position intermediate the opposite ends thereof.

Figure 13:
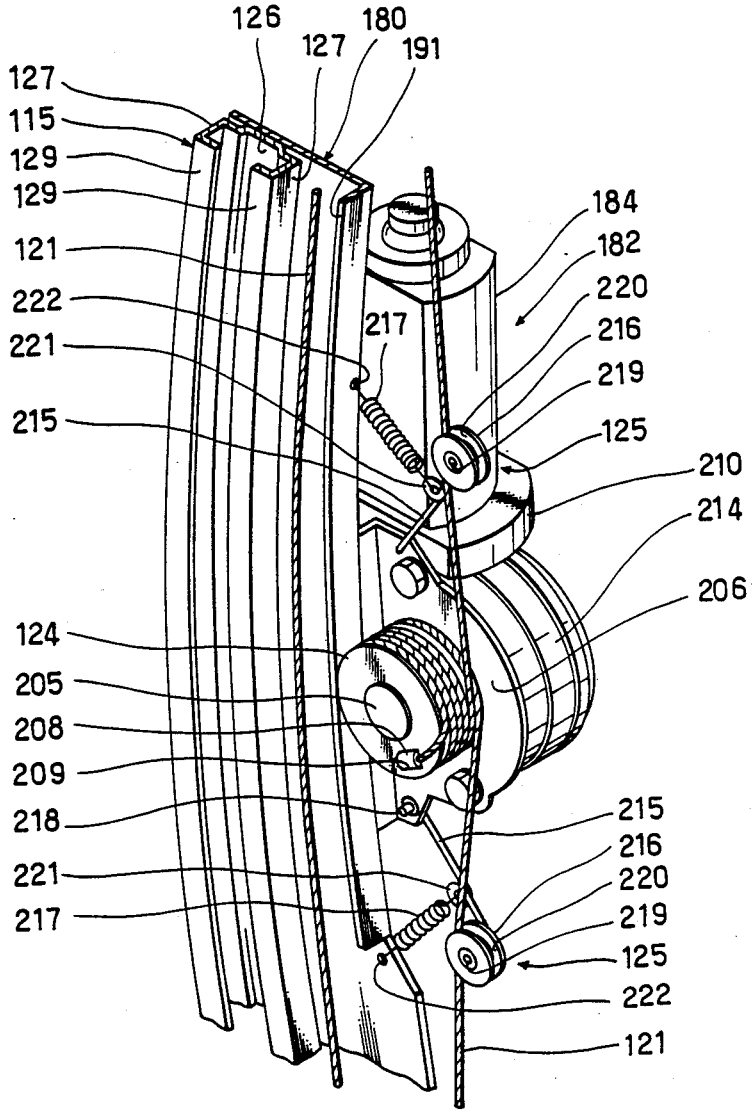
FIG. 13 is an enlarged, fragmentary perspective view of the window regulator of FIG. 10, showing in particular its drive means and cable tensioning means.

As will be seen also from FIG. 13, the drive reel 124 is driven by a drive mechanism 182 mounted to the concave side of the support structure 180. The drive mechanism 182 includes a reversible electric motor 184 geared to the drive reel 124. Thus the window regulator 110 is motor driven for moving the windowpane up and down with respect to the vehicle door frame.

The window regulator 110 employs a pair of tension means 125 in substitution for the slack take up means 25 of the foregoing embodiment. Disposed on the opposite sides of the drive reel 124, the pair of tension means 125 function for constantly imparting tension to the cable 121.

The listed important components of the window regulator 110 will be described in more detail hereinbelow in the order of the support structure 180, guide rail 115, windowpane carriage 117, drive reel 124, drive mechanism 182, and tension means 125.

Support Structure

With reference to FIGS. 10–14 the support structure 180 is generally in the shape of an elongate piece of sheet metal, with its opposite end portions 185 widened for rotatably supporting the terminal cable guide pulleys 119 and 120 on shafts 186 erected thereon. An offset mounting fin 187 extends from the top end of the support structure 180. A pair of bolts 188 on the mounting fin 187 are intended for use in mounting the support structure 180 to the vehicle door frame. FIGS. 11 and 12 reveal a U shaped mounting lug 189 affixed to the concave side of the support structure 180 adjacent its bottom end. A bolt 190 on the mounting lug 189 is also for use in mounting the support structure 180 to the door frame.

The right hand longitudinal edge, as seen in FIG. 10, of the support structure 180 is bent toward the convex side to provide a flange 191 extending between the pair of wider end portions 185 and in parallel spaced relation to the guide rail 115. The flange 191 coacts with the guide rail 115 for guiding the up and down motion of the windowpane carriage 117, as will be later explained in more detail.

Guide Rail

Also made of sheet metal, the guide rail 115 is spot welded or otherwide rigidly attached to the convex side of the support structure 180 so as to extend along its left hand longitudinal edge as viewed in FIG. 10. As will be best understood from FIGS. 13 and 14, the guide rail 115 comprises a web 126 held against the support structure 180, a pair of flanges 127 bent right angularly from the opposite longitudinal edges of the web 126, and a pair of inturned rims 129 formed by bending parts of the flanges 127 toward each other, thus providing the windowpane guideway 116 which is rectilinear as seen in an exterior view as in FIG. 10 but which is gently curved as seen in a side view as in FIG. 12. The flanges 127 are further provided with integral carriage stops 192, FIG. 10, at their opposite ends for limiting the travel of the windowpane carriage 117.

Windowpane Carriage

Figure 14:
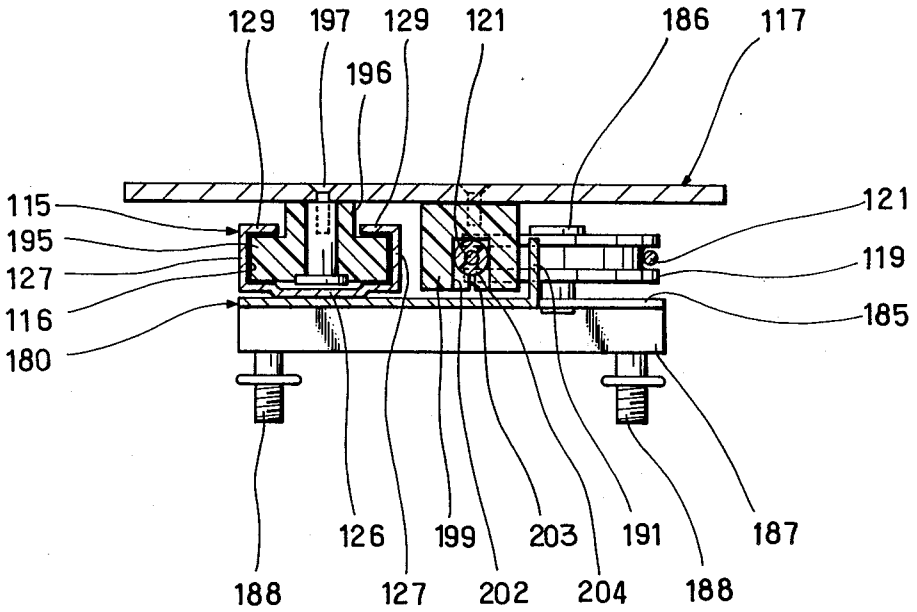
FIG. 14 is an enlarged section through the window regulator of FIG. 10, taken along the line XIV—XIV therein and showing in particular the windowpane carriage and its sliding engagement with the guide rail and support structure.
Figure 15:
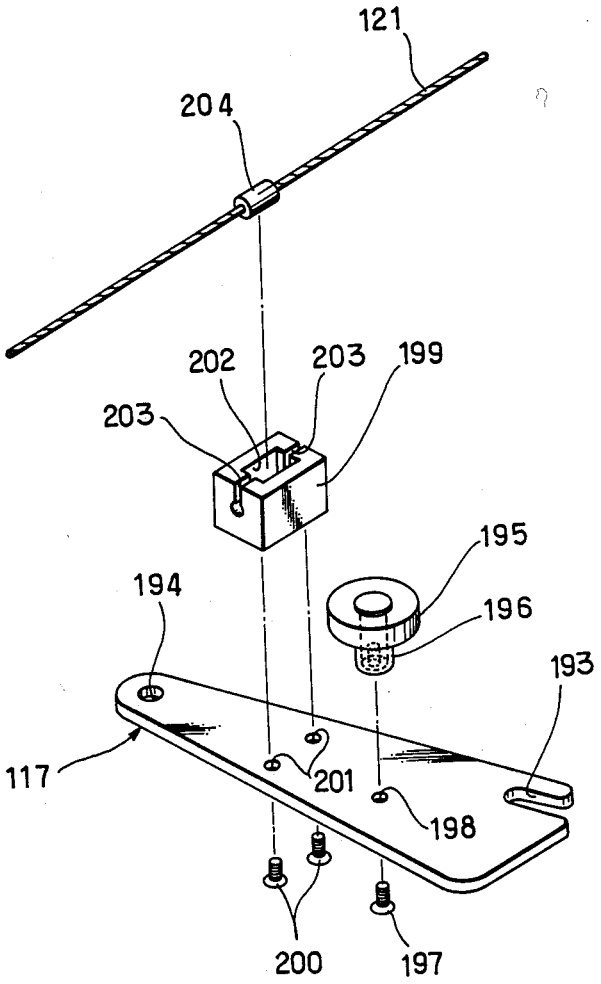
FIG. 15 is an enlarged, exploded perspective view of the windowpane carriage and other means associated therewith.

Although the windowpane carriage 117 appears in all of FIGS. 10–12 and 14, it is better shown in FIG. 15 as a flat piece of sheet metal elongated transversely of the guide rail 115. A mounting recess 193 and hole 194 formed adjacent the opposite ends of the windowpane carriage 117 are for use in securing the same to the windowpane with suitable fastener elements (not shown).

Seen at 195 is a slider or shoe in the form of a relatively thick disk with a diameter slightly less than the spacing between the pair of side flanges 127 of the guide rail 115. The slider 195 has a throat 196 of reduced diameter, slightly less than the spacing between the pair of inturned rims 129 of the guide rail 115. The slider 195 with the throat 195 is rigidly mounted to the windowpane carriage 117 approximately in a central position thereon by a screw 197 passing through a clearance hole 198 in the windowpane carriage. As best seen in FIG. 14, the slider 195 is slidably received in the guideway 116 defined by the guide rail 115 and thereby constrained to up and down motion without the likelihood of accidental detachment therefrom.

Also rigidly mounted to the windowpane carriage 117, in side by side relation to the slider 195, is a female coupling member 199 for use in connecting the windowpane carriage to the cable 121. The female coupling member 199 is secured to the windowpane carriage 117 by a pair of screws 200 passing through holes 201 in the carriage. FIG. 14 indicates that, so mounted to the windowpane carriage 117, the female coupling member 199 is somewhat loosely received between the longitudinal flange 191 of the support structure 180 and one of the flanges 127 of the guide rail 115. A socket 202 is formed centrally in the female coupling member 199 and communicates with a pair of aligned slits 203 on its upper and lower sides.

At 204 in FIG. 15 is seen a male coupling member in the form of a short metal tube fitted over and firmly engaged with the first or left hand stretch, as viewed in FIG. 10, of the cable 121. The male coupling member 204 is closely engaged in the socket 202 in the female coupling member 199, as best shown in FIG. 14, with the neighboring parts of the cable 121 received in the pair of slits 203. Thus the windowpane carriage 117 is coupled to the cable 121 against the possibility of sliding longitudinally of the cable.

Drive Reel

As shown in FIGS. 10, 12, 13 and 16, the drive reel 124 is mounted fast on a shaft 205 rotatably extending through a bearing plate 206 which is welded or otherwise secured to the support structure 180 in a position intermediate the opposite ends thereof. Thus the drive reel 124 is rotatable about an axis substantially normal to a plane tangent to the curved support structure 180 along a horizontal line containing the drive reel axis.

Figure 16:
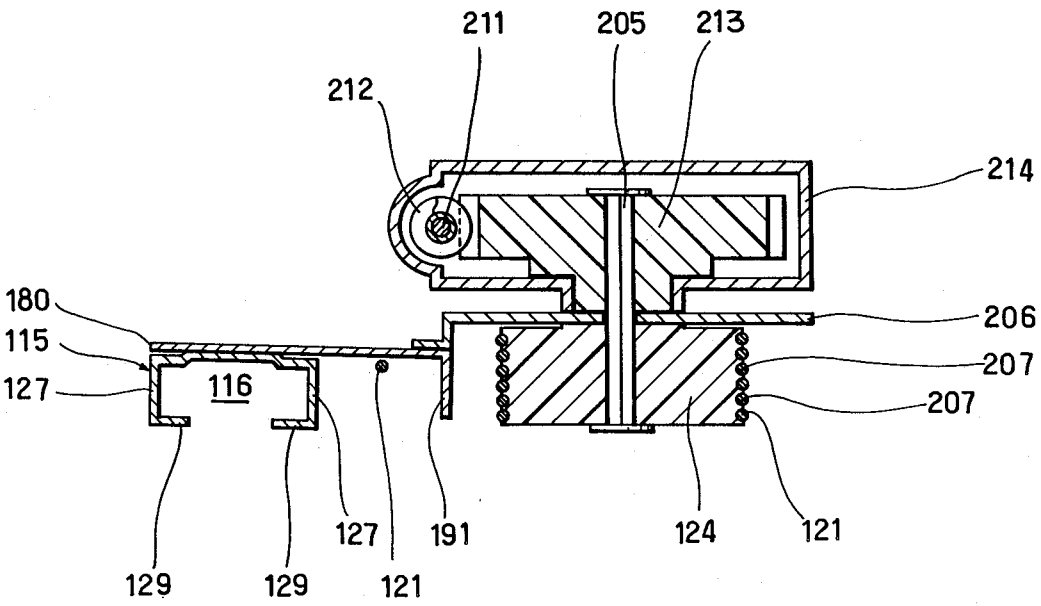
FIG. 16 is an enlarged section through the window regulator of FIG. 10, taken along the line XVI—XVI therein and showing in particular the drive reel and drive gearing.

The drive reel 124 has grooves 207, FIG. 16, cut helically in its surface. The cable 121 is not endless in this alternative embodiment, its opposite end portions being wound in the opposite directions around the drive reel 124 along its grooves 207. The opposite extremities 208, one seen in FIGS. 10 and 13, of the cable 121 are anchored to the drive reel 124 by being engaged in recesses 209 formed in its opposite end faces.

Drive Mechanism

The drive mechanism 182 is seen in FIGS. 10-13 and in part in FIG. 16. It includes the reversible electric motor 184, such as a direct current motor, bracketed at 210 to the concave side of the support structure 180. The motor 184 has an armature shaft 211 depending therefrom through the bracket 210. Rigidly mounted on this armature shaft is a worm 212 in mesh with a worm wheel 213 fixedly mounted on the shaft 205. The worm 212 and worm wheel 213 are both enclosed in a gear housing 214.

It is thus seen that the bidirectional rotation of the motor 184 is transmitted to the drive reel 124 via the intermeshing worm 212 and worm wheel 213. The bidirectional rotation of the drive wheel 124 is further translated into the up and down motion of the windowpane carriage 117 by the cable 121 running over the pair of pulleys 119 and 120.

Tension Means

With reference to FIGS. 10-13 the pair of tension means 125 are spaced from each other in the longitudinal direction of the support structure 180, with the drive reel 124 disposed therebetween. The two tension means 125 are of like construction, each comprising an arm 215, a tension roll 216 and a helical tension spring 217. Made of a length of wire, the arm 21 has one end bent right angularly at 218 for pivotal engagement in a hole formed in the bearing plate 206. The other end 219 of the arm is also bent right angularly for rotatably supporting the tension roll 216 thereon. The tension roll 216 has a groove 220, FIG. 13, formed in its periphery for rolling engagement with the cable 121. Further the arm 215 is looped at 221, and the helical tension spring 217 has one of its ends hooked to the loop 221, the other end being engaged with a hole 222 in the support structure 180.

Accordingly, those parts of the cable 121 which extend between upper pulley 119 and drive reel 124 and between lower pulley 120 and drive reel 124 are constantly urged toward the other cable stretch by the two tension rolls 216 under the forces of the springs 217. The cable 121 will thus remain tensioned throughout the prolonged period of use of the window regulator 110, assuring its proper operation.

It is to be appreciated that in this alternative embodiment, too, the cable drive means comprising not only the drive reel 124 but also the drive motor 184 are compactly disposed on the concave side of the guide rail 115 or of the support structure 180 without adding to the thickness of the window regulator 110. The space requirement of the window regulator 110 in its transverse direction, as seen in a front or rear view as in FIGS. 10 and 11, is therefore far less than heretofore. The apparatus may thus be conveniently mounted to vehicle doors and other objects where only limited installation spaces are available.

What is claimed is:

1. A motion translating mechanism for use as a vehicular window regulator or the like, comprising;

(a) elongate guide rail means curved longitudinally to provide a convex side and a concave side and defining a substantially linear guide way on its convex side, a pair of longitudinally spaced openings being defined in said guide rail means;

(b) a pair of terminal guides mounted to the convex side of the guide rail means adjacent opposite ends thereof;

(c) an elongate member of flexible, non-stretchable material looped about the terminal guides and so providing first and second stretches thereof, at least a first stretch of the elongate member extending along the guide way, and a second stretch of the elongate member extending through one of the openings from the convex toward the concave side of the guide rail means;

(d) a drive reel mounted to the guide rail means intermediate the opposite ends thereof and rotatably mounted to the concave side of the guide rail means, the second stretch of the elongate member extending through one of the openings from the convex toward to the concave side of the guide rail means and being wound at least one turn around the drive reel, and extending through the other opening from the concave back to the convex side of the guide rail means; and (e) a movable member mounted to the guide rail means and coupled to the first stretch of the elongate member for joint bidirectional movement therewith along the guide way.

2. The motion translating mechanism of claim 1 further comprising:

(a) a first pair of middle guides rigidly mounted to the guide rail means adjacent one of the openings therein for smoothly guiding the travel of the elongate member between the convex and concave sides of the guide rail means with a minimum of friction; and (b) a second pair of middle guides rigidly mounted to the guide rail means adjacent the other opening therein for smoothly guiding the travel of the elongate member between the convex and concave sides of the guide rail means with a minimum of friction;

(c) the first and second pairs of middle guides being all substantially of identical construction.

3. The motion translating mechanism of claim 2 wherein each middle guide comprises:

(a) a tubular guide portion extending along the guideway and receiving the elongate member; and (b) means defining a sloping guide groove communicating with the tubular guide portion, the guide groove extending through the associated opening in the guide rail means for guiding the elongate member between the convex and concave sides of the guide rail means.

4. The motion translating mechanism of claim 2 further comprising slack take up means for removing looseness from the elongate member, the slack take up means comprising:

(a) an abutment formed adjacent one of the terminal guides in fixed relation to the guide rail means;

(b) a tubular member of flexible material having one end held against the abutment and another end held against one of the middle guides, the tubular member slidably receiving the elongate member; and (c) a spring acting between said other end of the tubular member and said one middle guide for biasing the tubular member against the abutment;

(d) the tubular member being normally held linearly between the abutment and said one middle guide and flexing under the force of the spring upon loosening of the elongate member.

5. A motion translating mechanism for use as a vehicular window regulator or the like, comprising:

(a) elongate guide rail means curved longitudinally to provide a convex side and a concave side and defining a substantially linear guide way on its convex side;

(b) a pair of terminal guides mounted to the convex side of the guide rail means adjacent opposite ends thereof;

(c) an elongate member of flexible, non-stretchable material looped about the terminal guides and so providing first and second stretches thereof, at least the first stretch of the elongate member extending along the guide way;

(d) a drive reel rotatably mounted to the guide rail means intermediate the opposite ends thereof and at least partly disposed on the concave side of the guide rail means, the drive reel being drivingly coupled to the second stretch of the elongate member for bidirectionally driving the first stretch of the elongate member back and forth along the guide way;

(e) means including a drive motor disposed on the concave side of the drive rail means, the drive motor being drivingly coupled to the drive reel for imparting bidirectional rotation thereto; and (f) a movable member mounted to the guide rail means and coupled to the first stretch of the elongate member for joint bidirectional movement therewith along the guide way.

6. The motion translating mechanism of claim 5 wherein each tension means comprises:

(a) an arm pivoted at a first end on the guide rail means;

(b) a tension roll rotatably mounted on a second end of the arm and engaged with the second stretch of the elongate member; and (c) a spring acting between the guide rail means and the arm for urging the tension roll against the second stretch of the elongate member.

* * * * *